US007316992B2

(12) United States Patent
Natoli et al.

(10) Patent No.: US 7,316,992 B2
(45) Date of Patent: Jan. 8, 2008

(54) METHOD AND SYSTEM FOR MODIFYING A USED HYDROCARBON FLUID TO CREATE A CYLINDER OIL

(75) Inventors: Giuseppe Natoli, Turin (IT); Giulio Giovanni Pometto, Turin (IT); Alfio Bonciolini, Turin (IT); Hans Heinrich Petersen, Solrød Strand (DK); Jørn Dragsted, Alerød (DK); Niels-Henrik Lindegaard, Hellerup (DK); Claus Martin Olesen, Hillerød (DK); Klaus-Werner Damm, Chagrin Falls, OH (US)

(73) Assignee: A.P. Moller-Maersk A/S (DK)

( * ) Notice: Subject to any disclaimer, the term of this patent is extended or adjusted under 35 U.S.C. 154(b) by 263 days.

(21) Appl. No.: 11/012,052

(22) Filed: Dec. 14, 2004

(65) Prior Publication Data

US 2006/0068995 A1 Mar. 30, 2006

Related U.S. Application Data

(60) Provisional application No. 60/612,899, filed on Sep. 24, 2004.

(51) Int. Cl.

| | |
|---|---|
| ***C10M 175/00*** | (2006.01) |
| ***C10M 159/24*** | (2006.01) |
| ***C10M 159/22*** | (2006.01) |
| ***F02B 25/00*** | (2006.01) |
| ***F02B 75/16*** | (2006.01) |

(52) U.S. Cl. ..... 508/111; 508/391; 508/460; 440/88 L; 123/65

(58) Field of Classification Search ..... 508/111, 508/391, 460; 440/88 L; 123/65
See application file for complete search history.

(56) References Cited

U.S. PATENT DOCUMENTS

| | | | | |
|---|---|---|---|---|
| 4,505,835 | A | 3/1985 | Sung, et al. | |
| 5,067,455 | A * | 11/1991 | Okajima et al. | 123/196 R |
| 6,779,505 | B2 | 8/2004 | Reischman, et al. | |
| 6,845,745 | B2 | 1/2005 | Carey, et al. | |
| 2003/0159672 | A1 | 8/2003 | Carey, et al. | |
| 2004/0144355 | A1 * | 7/2004 | Carey et al. | 123/196 R |

FOREIGN PATENT DOCUMENTS

| | | | |
|---|---|---|---|
| GB | 1 183 345 | | 3/1970 |
| GB | 1183345 | A * | 3/1970 |
| GB | 2 084 667 | | 4/1982 |
| JP | 07054627 | A * | 2/1995 |

* cited by examiner

*Primary Examiner*—Glenn Caldarola
*Assistant Examiner*—Jim Goloboy
(74) *Attorney, Agent, or Firm*—Morgan, Lewis & Bockius LLP

(57) ABSTRACT

A method and system of creating a cylinder oil having a target TBN ranging from 40 to 70 for use in a two-stroke en line. Fresh system oil having a TBN less than 10 is provided. The fresh system oil is used in the two-stroke engine to product partially used system oil. An initial fluid containing at least some partially used system oil is provided. A first TBN of the initial fluid is determined. Cylinder oil having the target TBN is created by blending the initial fluid having the first TBN with at least one suited additive. The cylinder oil is provided to the two-stroke engine.

31 Claims, 1 Drawing Sheet

METHOD AND SYSTEM FOR MODIFYING A USED HYDROCARBON FLUID TO CREATE A CYLINDER OIL

This application claims the benefit of U.S. Provisional Application No.: 60/612,899 filed Sep. 24, 2004 and incorporates the same by reference.

FIELD OF THE INVENTION

The invention relates to a method of creating an all-loss lubricant. Further, the invention relates to a system for creating an all-loss lubricant.

BACKGROUND OF THE INVENTION

Two-stroke crosshead engines used in marine or stationary applications are equipped with two separate lubricating oil systems. One lubricating system comprises so-called system oil that normally is used for lubrication and cooling of the engine's bearings and e.g. oil-cooled pistons as well as for activation and/or control of various valves or the like. The other lubricating system comprises an all-loss lubricant (cylinder oil) that normally is used for lubrication of the engine's cylinders, piston rings and piston skirt.

In typical two-stroke crosshead engines, the cylinder oil is spent continuously by each turn of the engine whereas the system oil in principle is not spent (except by smaller unintentional leakages). The lubrication system comprising the cylinder oil is also often referred to as an "all-loss" lubrication system as the oil is spent. The use of and various types of both system oil(s) and cylinder oil(s) is very well known in the art.

The cylinder oil typically contains certain additives that function to reduce, minimize or neutralise the acid level of the cylinder system.

Typical cylinder oils usually have an SAE (Society of Automotive Engineering) viscosity equivalent to about 50 and normally have a total base number (TBN) of about 40 to 70 for the neutralisation of acid products produced during the combustion process. Typical system oils usually have an SAE viscosity of about 30 with a relatively low TBN content, typically below 10. These exemplary values may vary dependent on the actual application and the specific design of the systems that the oils are used in.

In recent two-stroke cross-head engine designs involving electronic and/or hydraulic control and/or activation of valves, etc., the minimum performance requirements of the system oil has been substantially increased compared to earlier design using traditional mechanical control/activation.

In four-stroke, trunk piston (diesel) engines, however, typically use only a single oil type for lubrication and cooling. Such engines are used as secondary/auxiliary or propulsion engines on ships, or in stationary power generation or liquid/gas transmission applications. Such used oils typically have a SAE viscosity of about 30 or 40. While the system oil of two-stroke cross-head engines typically remains within its specified performance limits for an extended period of time, trunk piston engine oils are constantly affected by exposure to the combustion process. However, due to the inherent design of two-stroke crosshead engines, spent cylinder lubricants invariably leaks past the piston rod stuffing box contaminating the system oil. Thus, the useful properties of both trunk piston engine and system oil degenerate over time and finally the oils will have to be either replenished or completely changed. Similarly, other lubricants used on-board vessels or at stationary sites, such as hydraulic fluids, gear oils, turbine oils, heavy duty diesel oils, system oils, trunk piston engine oils, compressor oils and the like, do deteriorate over time, due to e.g. contamination, oxidation, hydrolysis etc. and therefore have to be replenished or changed at certain intervals.

The performance level of lubricants is typically measured periodically and may not go beyond certain limits If the oiled component's condition should not be jeopardized. An important cause of performance loss is caused by particle contamination. These particles include combustion by-products and wear components, which can be partially removed by oil separators. However, in the case of two-stroke crosshead engines, one of the sources of contamination is spent cylinder oil leakage past the stuffing box causing both the viscosity and base number of the system oil to increase over time, a process that cannot be reversed by separators.

A diesel engine's frictional loss is mainly of a viscose character. An increase in the viscosity of the system oil will therefore result in a diminished efficiency, increased fuel consumption and increased emissions.

In order to manufacture cylinder oil, prior art methods and systems typically blend suited base oils and suited additives and/or an additive package to obtain a fully formulated cylinder lubricant. This is typically done at a dedicated lubricant blend plant and the resulting cylinder lubricant has to the delivered to a ship or an off-shore plant for use in engines.

Apart from the mentioned inevitable mixing of cylinder oil and system oil prior art methods and systems do not otherwise mix these types of oils. Further, some prior art methods/systems also suggest a variation in lubricant flow rate or properties in response to actual engine conditions, cf. e.g. U.S. Pat. No. 6,779,505. However, such methods and systems do not address the deterioration of oils due to contamination or other processes and the potential to re-use these used oils as cylinder oil.

OBJECT AND SUMMARY OF THE INVENTION

It is an object of the present invention to provide a method of creating a cylinder oil (and a corresponding system) that solves the above-mentioned (and other) shortcomings of prior art. A further object is to provide this in a cost-effective and simplified way.

A further object of the present invention is to enable improved performance of non-total loss lubricants over time and thus a more efficient use of both non-total loss lubricants and cylinder oil.

These objects, among others, are achieved by a method of (and corresponding system) creating a cylinder oil, the method comprising modification of at least one initial fluid by determining the TBN(s) of the at least one initial fluid, determining a desired TBN of a cylinder oil and adjusting the TBN(s) of the at least one initial fluid accordingly by blending the at least one initial fluid with suited additive(s).

In this way, a method for modifying an initial fluid to create cylinder oil by adjusting solely TBN is obtained.

This provides significant economical benefits since lubricants that otherwise would have to be disposed of can be re-used as a total-loss cylinder lubricant. Furthermore, cylinder oil does not have to be purchased. The oil(s) used to blend the cylinder oil is/are of more consistent quality as it is replenished (contrary to the traditional practice) which reduces machinery wear, etc. Thus, the replenishment of the initial fluid(s) provides enhanced and consistent performance of the initial fluids resulting in greatly reduced component wear and equipment lifecycle cost. Even further, a more environmentally friendly method/system is provided since waste, in the form of spent oil(s) that is discarded after prolonged use, is reduced as it is converted into cylinder oil.

Preferably, at least one of the initial fluids are at least partially used oil(s). Hereby, a fully formulated cylinder lubricant is obtained by modifying TBN of this used initial fluid(s).

In a preferred embodiment, the suited additive(s) comprise at least one base.

In a further preferred embodiment, the at least one base comprises 1. basic salts of alkaline or earth alkaline elements, and/or
2. detergents and/or
3. dispersants.

The alkaline/earth alkaline elements may be e.g. K, Na, Ca, Ba, Mg or the like. The basic salts may belong to the inorganic chemical families of e.g. oxides, hydroxides, carbonates, sulfates or the like. The detergents may belong to the organic chemical families of e.g. sulfonates, salicylates, phenates, sulfophenates, Mannich-bases and the like. The dispersants may belong to the organic chemical families of succinimides or the like.

In a preferred embodiment, the cylinder oil Is used in reciprocating internal combustion engines used in marine or stationary applications.

In yet another embodiment, the reciprocating internal combustion engines are two-stroke crosshead engines.

Preferably, the method and embodiments thereof according to the present Invention is used offshore, on-site or in a land based plant.

Preferably, the cylinder oil is created with a TBN in response to fuel oil characteristics and/or actual engine operating requirements.

In another preferred embodiment, the TBN of the cylinder oil Is chosen based upon sulphur-content of the fuel oil.

Preferably, the initial fluid is a hydrocarbon fluid. In one embodiment, the hydrocarbon fluid is a lubricant.

In a preferred embodiment, the lubricant is a used lubricant, i.e. a lubricant that has at least been partially used elsewhere.

Preferably, the used lubricant is selected from a group of lubricants, such as hydraulic fluids, gear oils, system oils, trunk piston engine oils, turbine oils, heavy duty diesel oils, compressor oils and the like.

In a preferred embodiment, the created cylinder oil is based on two-stroke engine system oil that continuously, near-continuously or intermittently is tapped from an existing system and where the system oil is replenished.

In an alternative preferred embodiment, the created cylinder oil is based on a mixture of lubricants that continuously, near-continuously or intermittently are tapped from an existing system and where the lubricants are replenished.

The oils used as initial fluids may e.g. be used or could alternatively be non-used, i.e. straight from any fresh lubricant storage tank or the like.

In another embodiment, the method further comprises the step of using suited instrumentation in order to control the quality of the finished lubricant.

The present invention also relates to a system corresponding to and having the same advantages as the method of the present invention. More specifically, the present invention also relates to a system for providing a cylinder oil, the system comprising: an apparatus for modifying at least one initial fluid by determining the TBN(s) of the at least one initial fluid, determining a desired TBN of a cylinder oil and adjusting the TBN(s) of the at least one initial fluid accordingly by blending the at least one initial fluid with suited additive(s).

Advantageous embodiments of the system according to the present invention are defined In the subclaims and described in detail in the following. The embodiments of the system correspond to the embodiments of the method and have the same advantages for the same reasons.

BRIEF DESCRIPTION OF THE DRAWINGS

These and other aspects of the invention will be apparent from and elucidated with reference to the illustrative embodiments shown in the drawing, in which.

DESCRIPTION OF PREFERRED EMBODIMENTS

Figure 1:
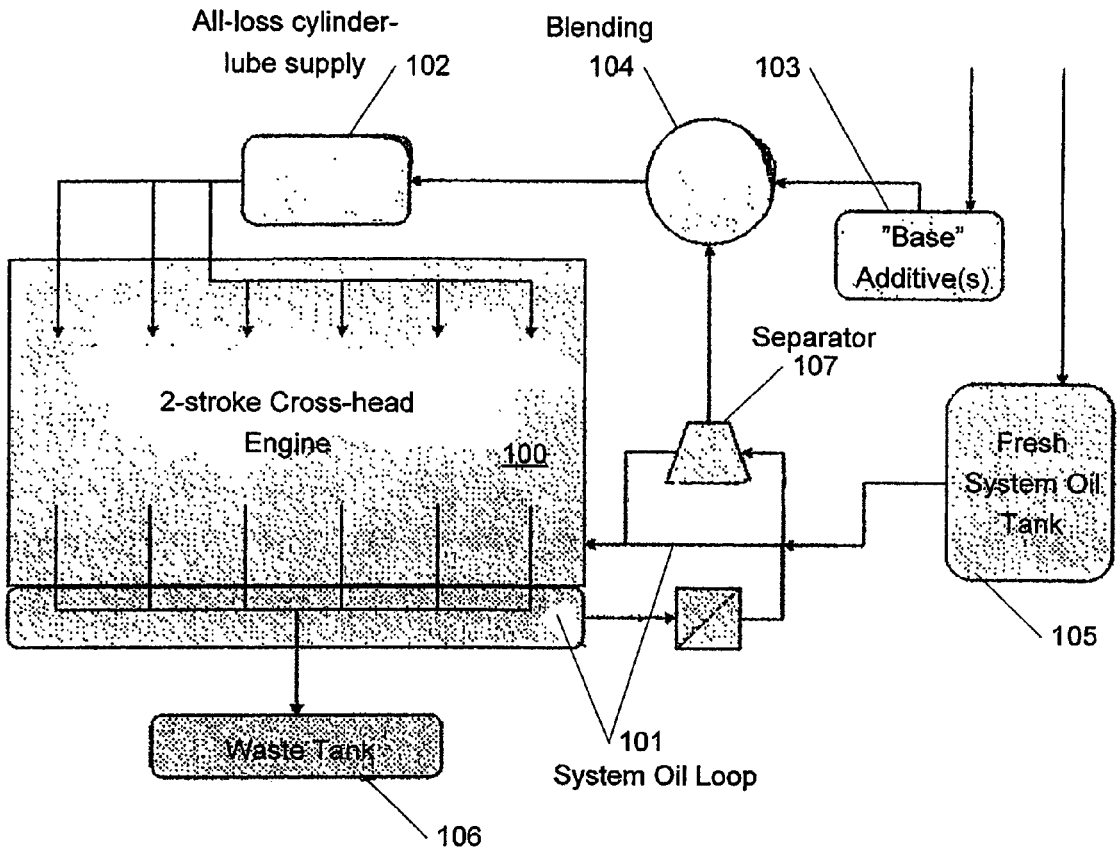
FIG. 1 shows a schematic block diagram of one embodiment according to the present invention.

FIG. 1 shows a schematic block diagram of one embodiment according to the present invention. Shown are an all-loss cylinder lubricant supply comprising cylinder oil (102), base additive(s) (103) and a system oil loop comprising at least one initial fluid (101). Further shown is a two-stroke crosshead engine (100), a waste tank (106), a fresh system oil tank (105), a separator (107) and a blending apparatus (104) for carrying out the present invention.

According to the present invention the cylinder oil is created by modification of at least one initial fluid (101) by determining the TBN(s) of the at least one initial fluid, determining a desired TBN of a cylinder oil (102) and adjusting the TBN(s) of the at least one initial fluid (101) accordingly by blending the at least one initial fluid (101) with suited additive(s) (103). This is preferably done by the blending apparatus (104). Preferably, the at least one initial fluid are at least partially used oil(s). Hereby, a fully formulated cylinder lubricant is obtained by modifying TBN of spent oil.

Adjusting the TBN preferably comprises adjusting at least one additive level or adding one or more additives, where the additives comprise at least one base comprising basic salts of alkaline or earth alkaline elements, and/or detergents and/or dispersants.

The alkaline/earth alkaline elements may be e.g. K, Na, Ca, Ba, Mg or the like. The basic salts may belong to the Inorganic chemical families of e.g. oxides, hydroxides, carbonates, sulfates or the like. The detergents may belong to the organic chemical families of e.g. sulfonates, salicylates, phenates, sulfophenates, Mannich-bases and the like. The dispersants may belong to the organic chemical families of succinimides or the like.

As mentioned, the cylinder oil may be used in reciprocating internal combustion engines (e.g. two-stroke crosshead engines) used in marine or stationary applications. The creation of a cylinder oil is due to its simplicity and the normal availability of the required initial fluid and the additives very suitable for offshore or on-site applications.

The creation of the cylinder oil may also take additional aspects into consideration such as actual engine requirements and sulphur content of the fuel.

The used initial fluid may e.g. be hydraulic fluids, gear oils, system oils, trunk piston engine oils, turbine oils, heavy duty diesel oils, compressor oils and the like.

Preferably, the initial fluid is system oil and the total-loss lubricant is cylinder oil.

In one embodiment, the created cylinder oil is based on two-stroke engine system oil that continuously, near-continuously or intermittently is tapped from an existing system and where the system oil Is replenished.

Alternatively, the created cylinder oil is based on a mixture of oils that continuously, near-continuously or intermittently are tapped from an existing system and where the oils are replenished.

The oils may e.g. be used or could alternatively be non-used, i.e. straight from any fresh lubricant storage tank or the like.

A significant advantage of the present invention is that the main engine(s) only has to be supplied with fully-formulated, fresh system oil. The system oil is then used for its traditional purpose and some of the system oil is blended with additives adjusting the TBN making it suitable for cylinder oil according to the present invention. This increases the availability of the needed oil geographically and increases competition between supplies of oil since all presently known two-stroke system oils are usable as initial oil for the cylinder oil by using the present invention. Further, since, where applicable, other initial fluids, such as but not limited to used hydraulic, gear, trunk piston engine or compressor oils may be included in the process of creating cylinder oil procurement cost will be considerably reduced.

Further, since some of initial fluids are now re-used in the manufacture of cylinder oil (as opposed to their traditional use) they will have to be replenished whereby the problem of gradual deterioration is minimised or avoided.

In a preferred embodiment, a continuous, near-continuous or intermittently tapping of the system oil from a two-stroke main engine and/or any other suited initial fluid is proposed to use these initial fluids as a basis for the creation of cylinder oil according to the present invention.

The additive(s) or additive package used by the modifier may serve several purposes but will normally always be used for adjusting the oils TBN. The process may also be used to provide flexible TBN levels as required by the actual fuel oil properties and engine operating parameters.

The creation of cylinder oil/cylinder oil according to the present invention is due to its simplicity very well suited for on-site creation, e.g. aboard a ship/vessel, off-shore equipment, stationary plants, etc.

In the claims, any reference signs placed between parentheses shall not be constructed as limiting the claim. The word "comprising" does not exclude the presence of elements or steps other than those listed in a claim. The word "a" or "an" preceding an element does not exclude the presence of a plurality of such elements.

The invention claimed is:

1. A method of creating a cylinder oil having a target TBN ranging from 40 to 70 for use in a two-stroke engine, the method comprising:

providing a fresh system oil having a TBN less than 10;

using said fresh system oil in the two-stroke engine to produce partially used system oil;

providing an initial fluid containing at least some of said partially used system oil;

determining a first TBN of the initial fluid;

creating cylinder oil having the target TBN by blending the initial fluid having the first TBN with at least one suited additive; and providing sad cylinder oil to the two-stroke engine.

2. A method according to claim 1, wherein the at least one suited additive comprises at least one base.

3. A method according to claim 2, wherein the at least one base comprises one or more of the following: basic salts of alkaline or earth alkaline elements, detergents and dispersants.

4. A method according to claim 1 wherein the two-stroke engine is a reciprocating internal combustion engine used in a marine or stationary application.

5. A method according to claim 4 wherein the two-stroke engine is a two-stroke crosshead engine.

6. A method according to claim 1, wherein the method is performed offshore, on-site or in a land based plant.

7. A method according to claim 1, further comprising defining the target TBN based on one or more of the following: fuel oil characteristics of fuel oil supplied to the two-stroke engine and actual engine operating requirements of the two-stroke engine.

8. A method according to claim 7, further comprising defining the target TBN based upon sulphur content of the fuel oil.

9. A method according to claim 1, wherein said initial fluid is a hydrocarbon fluid.

10. A method according to claim 9, wherein said hydrocarbon fluid is a lubricant.

11. A method according to claim 10, wherein the lubricant is a used lubricant.

12. A method according to claim 11, wherein the used lubricant is selected from a group of hydraulic fluids, trunk piston engine oils, turbine oils, heavy duty diesel oils, compressor oils and the like.

13. A method according to claim 1, further comprising continuously, near-continuously or intermittently tapping said two-stroke engine for said partially used system oil; and replenishing with fresh system oil.

14. A method according to claim 1, further comprising continuously, near-continuously or intermittently tapping said two-stroke engine for a mixture of lubricants; and replenishing the lubricants.

15. A method according to claim 1, wherein the method further comprises the step of: using suited instrumentation in order to control quality of the cylinder oil.

16. A system for creating cylinder oil having a target TBN ranging form 40 to 70 for use in a two-stroke engine, the system comprising:

a fresh system oil tank connected to a two-stroke engine, wherein said fresh system oil tank provides fresh system oil having a TBN of less than 10 to the two-stroke engine, and wherein said two-stroke engine converts said fresh system oil into partially used system oil by using said fresh system oil as a lubricant during operation of said two-stroke engine;

a system oil loop connected to said two-stroke engine;

a blending apparatus coupled to said system oil loop wherein said system oil loop obtains said partially used system oil from said two-stroke engine, re-circulates at least some of said partially used system oil back to said two-stroke engine through a system oil input port of said two-stroke engine, and supplies at least some of said partially used system oil to said blending apparatus:

a base additive tank coupled to said blending apparatus, wherein the base additive tank supplies at least one suited additive to the blending apparatus;

wherein the blending apparatus produces the cylinder oil having the target TBN by blending an initial fluid containing at least some of said partially used system oil supplied by the system oil loop with at least one suited additive supplied by the base additive tank;

a cylinder oil supply tank, coupled to an output of said blending apparatus, wherein the cylinder supply tank, stores the cylinder oil having target TBN; and a cylinder oil supply conduit that supplies the cylinder oil having the target TBN from said cylinder oil supply tank to a cylinder oil input port of said two-stroke engine.

17. A system according to claim 16, wherein the at least one suited additive comprises least one base.

18. A system according to claim 17, wherein the at least one base comprises one or more of the following: basic salts of alkaline or earth alkaline elements, detergents and dispersants.

19. A system according to claim 16, wherein the two-stroke engine is a reciprocating internal combustion engine used in a marine or stationary application.

20. A system according to claim 19, wherein the two-stroke engine is a two-stroke crosshead engine.

21. A system according to claim 16, wherein the system is offshore, on-site or in a land based plant.

22. A system according to claim 16, wherein the target TBN is defined based on one or more of the following: fuel oil characteristics of fuel oil supplied to the two-stroke engine and actual engine operating requirements of the two-stroke engine.

23. A system according to claim 16, wherein the target TBN is defined based upon sulphur-content of the fuel oil.

24. A system according to claim 16, wherein said initial fluid is a hydrocarbon fluid.

25. A system according to claim 24, wherein said hydrocarbon fluid is a lubricant.

26. A system according to claim 25, wherein the lubricant is a used lubricant.

27. A system according to claim 26, wherein the used lubricant is selected from a group of hydraulic fluids, gear oils, trunk piston engine oils, turbine oils, heavy duty diesel oils, compressor oils and the like.

28. A system according to claim 16, wherein the system continuously, near-continuously or intermittently taps said two-stroke engine for system oil; and replenishes with fresh system oil.

29. A system according to claim 16, wherein the system continuously, near-continuously or intermittently taps said two-stroke engine for a mixture of lubricants: and replenished the lubricants.

30. A system according to claim 16, wherein the system further comprises suited instrumentation useable for controlling quality of the cylinder oil.

31. The system according to claim 16, further comprising a flesh system oil tank containing fresh system oil having a TBN value less than 10, wherein fresh system oil is combined with partially used system oil prior to re-circulation of the partially used system oil through the system oil input port of said two-stroke engine.

* * * * *